United States Patent [19]

Chenot

[11] Patent Number: 4,661,894

[45] Date of Patent: Apr. 28, 1987

[54] STABILIZING DEVICE FOR LUMINAIRE SUPPORT RING

[75] Inventor: Louis A. Chenot, North Canton, Ohio

[73] Assignee: Metaltec Corporation, Canton, Ohio

[21] Appl. No.: 646,213

[22] Filed: Aug. 31, 1984

[51] Int. Cl.[4] ..... F21V 21/36; F21V 21/14

[52] U.S. Cl. ..... 362/391; 362/403; 362/431

[58] Field of Search ..... 362/403, 391, 431; 240/64, 65, 66, 67, 68

[56] References Cited

U.S. PATENT DOCUMENTS

| | | | |
|---|---|---|---|
| 3,673,403 | 6/1972 | Woods | 362/403 |
| 3,696,241 | 10/1972 | Meyer | 362/403 |
| 3,801,813 | 4/1974 | Kiehn | 362/391 |
| 3,847,333 | 11/1974 | Zeller | 240/64 |
| 3,911,267 | 10/1975 | Kiehn | 240/64 |
| 4,001,573 | 1/1977 | Derasp | 240/64 |
| 4,092,707 | 5/1978 | Millerbernd | 362/391 |
| 4,195,332 | 3/1980 | Thompson | 362/391 |
| 4,228,488 | 10/1980 | Garchinsky | 362/403 |
| 4,237,530 | 12/1980 | Murray | 362/391 |
| 4,316,238 | 2/1982 | Booty | 362/391 |
| 4,348,717 | 8/1982 | Thompson | 362/403 |

*Primary Examiner*—Carl S. Miller

*Attorney, Agent, or Firm*—Sand & Hudak Co.

[57] ABSTRACT

A device for maintaining a luminaire support ring centered about and stabilized on a pole as it is being raised and lowered along the pole. A plurality of spaced stabilizing arms are pivotally mounted on the support ring and are biased into engagement with the pole by individual cables which also provide the raising and lowering means for the support ring. The cables provide a constant centering and stabilizing force exerted by the arms against the pole throughout the vertical travel of the support ring uneffected by changes in pole diameter. Tapered rollers mounted on the arms engage the pole to provide a lower friction sliding engagement therebetween. The arms also extend a predetermined distance beyond the pole engaging rollers to maintain the pole trapped between the arms should the support ring move off-center from the pole. The cables are connected to the arms by compression coil springs to provide resiliency to the system to compensate for manufacturing tolerances to insure latching of the support ring at the pole top. Cable sheaves mounted on the support ring change the direction of the cables 90° from their horizontal engagement with the arms to an upward vertical movement toward second cable sheaves mounted on a fixed support at the pole top for directing the cables downwardly through the pole interior.

21 Claims, 13 Drawing Figures

FIG. 4
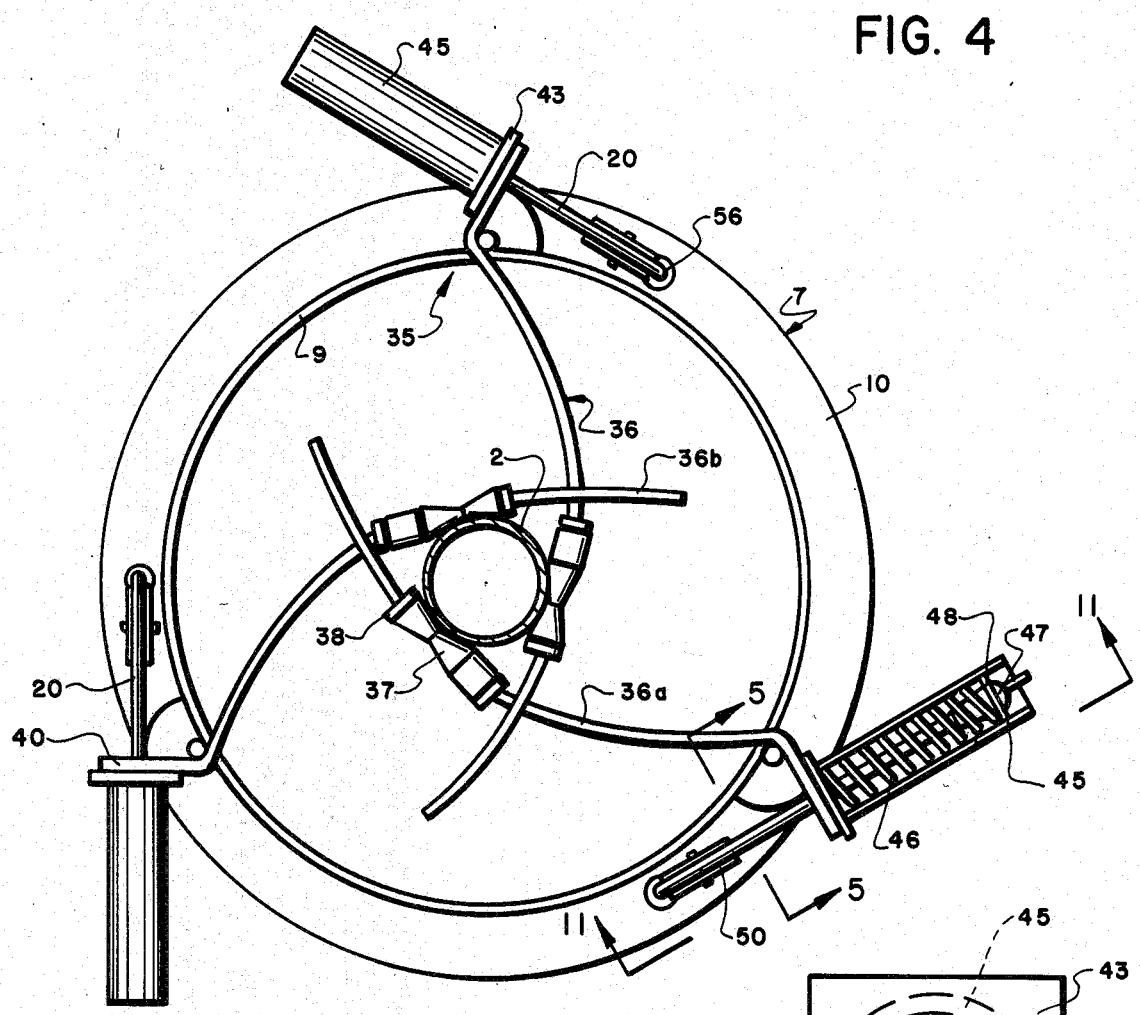
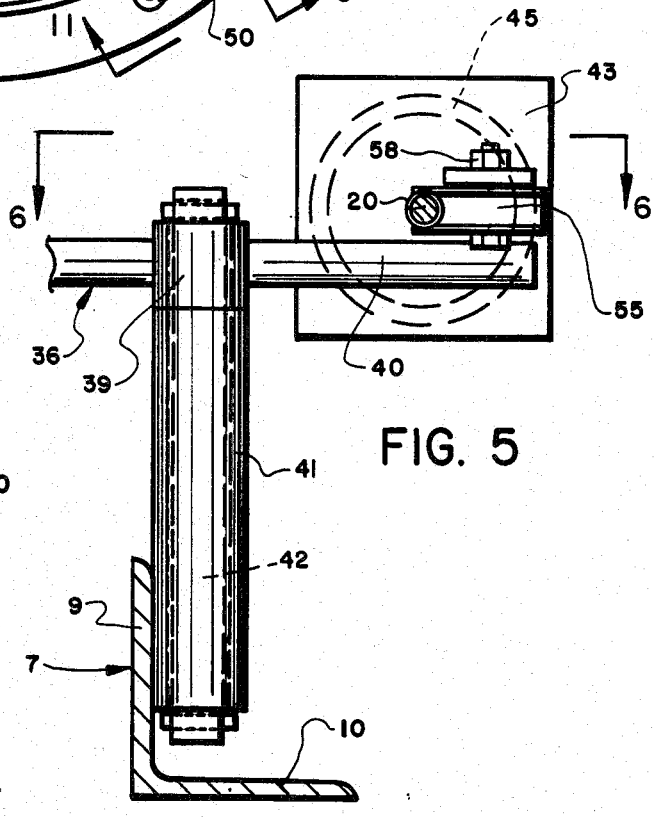
FIG. 5
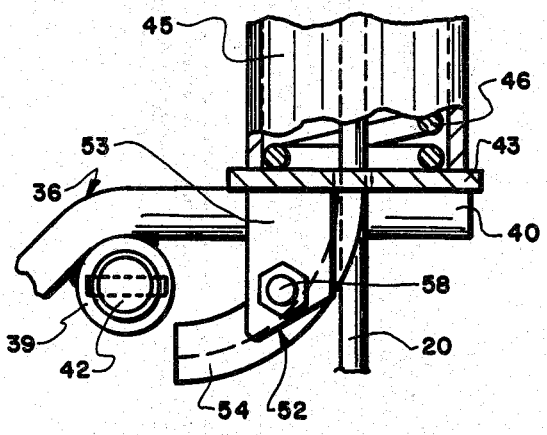
FIG. 6

STABILIZING DEVICE FOR LUMINAIRE SUPPORT RING

TECHNICAL FIELD

The invention relates to outdoor lighting and in particular to the type of lighting in which a plurality of luminaires are mounted on a ring which is movably mounted adjacent the top of a high pole. More particularly, the invention relates to a device for maintaining the luminaire support ring centered on the pole and in a stabilized condition as it is moved vertically along the pole, with the stabilizing force applied to the ring remaining constant and uneffected by the changing diameter of the pole.

BACKGROUND ART

In recent years, outdoor lighting such as street lighting, parking lot lighting and area lighting has been mounted on higher and higher poles enabling more luminaires to be mounted on a single pole than heretofore possible reducing the amount of individual poles that must be installed to obtain the same surface lighting. This reduction in the number of poles is desirable adjacent highways especially at intersections since fewer poles reduce the accident hazard to motorist.

These newer poles have obtained heights of 150 feet or more which makes the replacement of the bulb or lamps inaccessable to conventional bucket trucks or "cherry pickers" heretofore used for replacing the bulbs of conventional height lighting poles. Likewise, it is impractical to have built-in or removable ladders attached to the exterior of the pole to enable maintenance personnel to ascent to the top of such poles to service the luminaires.

To meet this difficult problem of bulb replacement and general maintenance, a number of devices have been involved. First, the individual lights were suspended by steel cables which pass through the hollow pole and over pulleys at the top so that each light could be lowered to the ground when desired simply by unwinding a sufficient length of cable connected with the individual light. The problem with this arrangement was that lights simply hung from individual steel cables tended to be blown around or sway in the wind causing cable wear and damage to the light by the continuous movement. Also, over an extended period of time the steel cables tended to stretch causing the lights to be lower than the desired height.

A later approach was to mount several of the lights on a movable carrier or support ring which was lowered to the ground by internal steel cables to permit access to the lights after which the ring was raised by the same cables to the normal height where they were latched onto a fixed support or platform permanently secured to the top of the pole. Some examples of such multiple luminaire support rings and the lower and raising system therefore are shown in U.S. Pat. Nos. 3,801,813; 3,862,744; 3,958,116; 4,001,573; 4,025,782; 4,228,488; 4,237,530; and 4,348,717.

However, when utilizing such a ring-like luminaire support it must remain centered around the support pole as it travels up and down the pole especially adjacent the top of the pole where it is located. Alignment is critical at the top of the pole to insure cooperative latching with the associated latching mechanism mounted on the fixed top support. This centering and alignment of the support ring is difficult to achieve even on relatively calm days due to wind forces on the ring as it obtains substantial heights on the pole.

One type of construction for overcoming the centering and stabilizing problem has been the use of a plurality of individual centering elements each of which is biased into engagement against the pole by springs. Usually three or four such biased elements have been used in such installations. One of the problems with such devices is that as the support ring moves off center, one of the stabilizing arms or elements attempts to recenter the support as intended. However, the remaining stabilizing arms provide a counterforce opposing the restoring force which actually reduces the effectiveness of the centering mechanism.

Another problem with such spring controlled stabilizing devices is that they do not exert a constant linear force on the pole as the pole diameter varies. An extremely high pole may vary in size from a diameter of several feet at the bottom to only several inches at the top. Tension or compression coil springs or other type springs used for applying the biasing force on the centering and stabilizing elements are not linear elements and therefore cannot exert a linear force. The force exerted is less as the spring is stretched and the stabilizer arms moved further away from the tensioning element as the pole diameter decreases. Thus, in the area where the greatest stabilizing force is required adjacent the pole top, the force exerted by the stabilizing members is lowest due to the use of springs.

Still another problem with known stabilizing and centering devices is that if the ring moves off center, even momentarily, one of the stabilizing arms may move out of contact with the pole and move beyond the pole in the biasing direction preventing the ring from returning to its trapped position between the stabilizing arms even after it attempts to return to its on-center position. Such movement of the arm could result in complete stopage of the ring movement requiring a difficult maintenance procedure to be performed on the ring to place the arms on the correct side of the pole to enable the ring to move freely vertically along the pole. U.S. Pat. No. 3,847,333 attempts to overcome this centering and stabilizing problem by providing a plurality of arms which are engaged with the hole and which act in unison by a plurality of connecting rods. However, the device of this patent still uses a spring to apply the tensioning force which will not provide the desired linear tensioning force. U.S. Pat. No. 4,348,717 shows another type of luminaire support ring centering device which uses torsion springs in combination with meshing gears in an attempt to achieve a uniform engagement. Again, the use of springs will not enable the linear constant tension to be achieved.

U.S. Pat. No. 4,092,707 discloses a centering and stabilizing device which uses the control cables for applying a force to a plurality of centering arms. However, the structure of this patent is relatively complicated and expensive and requires a parallelogram type linkage for moving the arms into contact with the pole. Also the pole contacting rollers are mounted on the outer end of the arms and could become disengaged from the pole requiring a costly maintenance procedure for correcting the situation.

Therefore the need has existed for an improved inexpensive, relatively simple stabilizing and centering device for a luminaire support ring which provides for a constant linear tensioning force of the stabilizing elements against the pole regardless of the changing pole diameter and vertical position of the support ring on the pole.

DISCLOSURE OF THE INVENTION

Objectives of the invention include providing an improved stabilizing device for a luminaire support ring which enables a plurality of luminaires mounted on the support ring to be raised and lowered conveniently and safely along a pole relatively unaffected by elevated winds, and more importantly which enables the support ring to be maintained centered about the pole to facilitate latching of the support ring with cooperating latching mechanisms mounted on a fixed plate at the top of the pole. Another objective is to provide such an improved device in which a plurality of stabilizing arms pivotally mounted on the support ring, provide the centering and stabilizing effect for the ring by engaging the pole as the ring moves vertically therealong; and in which the arms maintain a constant linear pressure against the pole unaffected by the changing pole diameter throughout the length of the pole.

Still another objective of the invention is to provide such a stabilizing device in which the linear pressure exerted by the stabilizing arms is achieved by individually connecting the support ring raising and lowering cables to the stabilizing arms to provide the biasing force on the arms; in which the cables are connected to the arms through compression coil springs which provides sufficient resiliency to the support ring to compensate for any minor manufacturing tolerances to insure latching of the support ring at the pole top; in which the ends stabilizing arms are engaged with the pole by rollers to reduce the sliding friction therebetween; and in which the ends of the stabilizing arms are prevented from snapping beyond the pole if the support ring moves a considerable distance off center thereby ensuring that the pole is maintained trapped between a plurality of the stabilizing arms at all times.

A further objective of the invention is to provide such an improved stabilizing device which includes an improved signalling means which indicates to an operator at ground level that all of the individual latching mechanisms of the support ring are in latched position. Another objective is to provide such a device in which the support ring cables are connected to the stabilizing arms through cable shieves and guides which provide a continuous smooth surface for changing the direction of the cables to prevent injury to the cables during pivotal movement of the stabilizing arms. A still further objective is to provide such a device which is constructed with a relatively few components, which provides a sturdy and durable device relatively maintenance free, and which achieves the stated objectives in an extremely simple and relatively inexpensive manner.

These objectives and advantages are obtained by the improved device of the invention the general nature of which may be stated as including a device for maintaining and stabilizing a support ring in a predetermined position encircled about a pole, in which said ring is of the type which is raised and lowered along the pole by a plurality of cables which extend upwardly through the pole interior and over cable sheaves mounted on a fixed platform on top of the pole and then downwardly to the support ring; said device including a plurality of stabilizing arms moveably mounted on the support ring and operatively connected to the cables whereby the tension in the cables bias the arms horizontally inwardly into engagement with the pole, said arms having a length greater than the radius of the support ring so as to extend beyond the pole to prevent disengagement of the arms from said pole; and cable sheave means mounted on the support ring adjacent the stabilizing arms for changing the direction of the connected cables 90° from vertical to horizontal for connection to the stabilizing arms.

BRIEF DESCRIPTION OF THE DRAWINGS

A preferred embodiment of the invention, illustrative of the best mode in which applicant has contemplated applying the principles, is set forth in the following description and is shown in the drawings and is particularly and distinctly pointed out and set forth in the appended claims.

FIG. 4 is a sectional view taken on line 4—4, with one of the spring housings shown in section;

FIG. 5 is an enlarged fragmentary sectional view taken on line 5—5, FIG. 4;

FIG. 6 is a fragmentary sectional view taken on line 6—6, FIG. 5;

Similar numerals refer to similar parts throughout the drawings.

BEST MODE FOR CARRYING OUT THE INVENTION

Figures 1, 8:
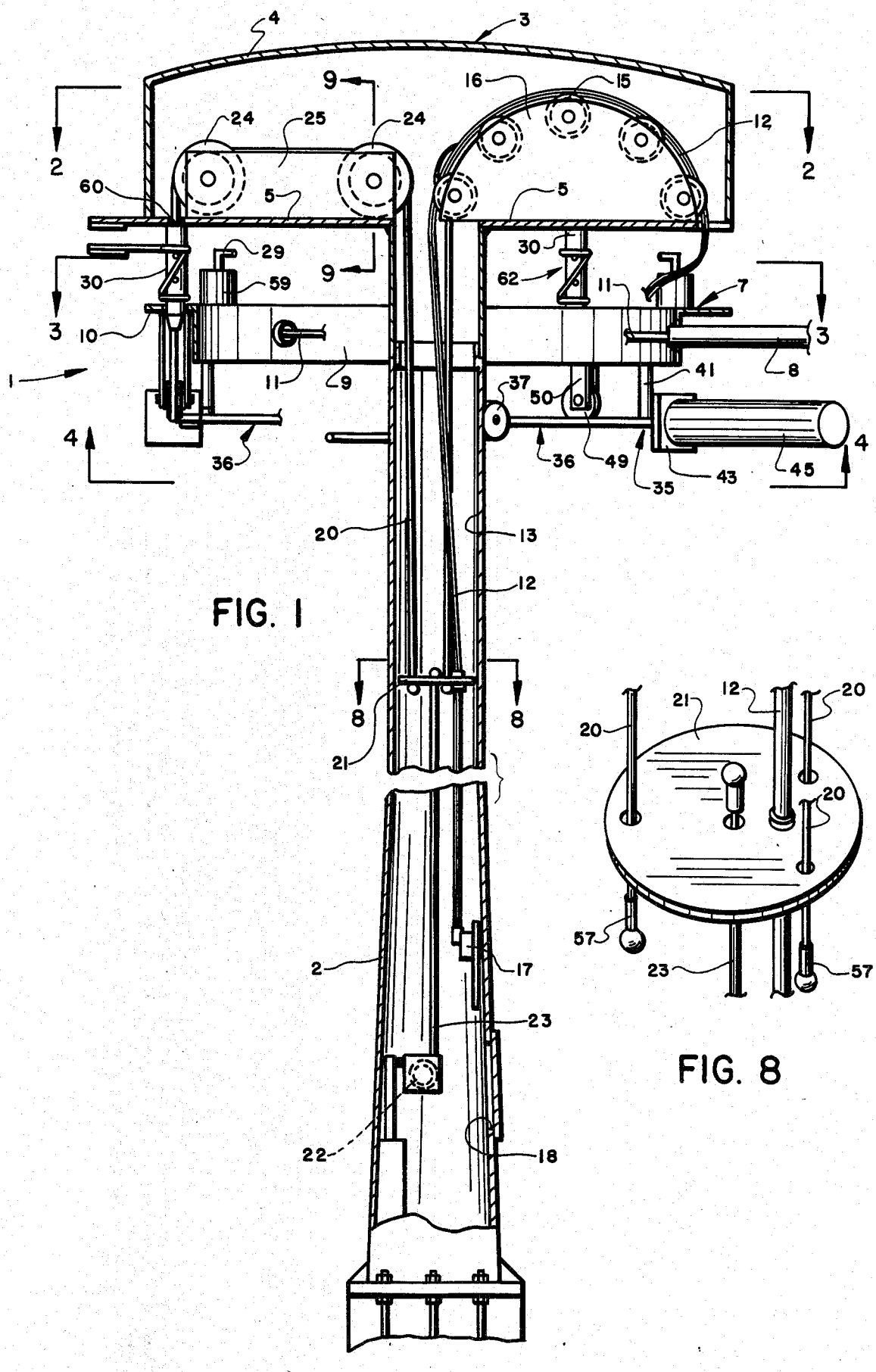
FIG. 1 is a side elevational view shown partly in section and broken away of the improved stabilizing device and associated luminaire support ring mounted on a lighting pole.
FIG. 8 is an enlarged sectional view taken on line 8—8, FIG. 1.

The improved stabilizing device is indicated generally at 1, and is shown in FIG. 1 suspended in an unlatched position beneath a mast head indicated generally at 3, which is mounted on top of a pole 2. Mast head 3 includes a dome-shaped cover 4, preferably formed of sheet metal, and a generally disc shaped base 5 which is securely attached by welds or the like to the top of the pole 2.

Stabilizing device 1 includes an annular or ring shaped luminaire support indicated generally at 7, on which is attached a plurality of outwardly extending luminaire support arms 8. Ring 7 includes a cylindrical wall 9 and an outwardly extending annular top wall 10. The luminaire support arms 8 are secured in side wall 9 by welds or similar attachment means with the luminaire electrical wires 11 being connected at a junction box (not shown) to a main electric supply cable 12 which extends downwardly through the hollow interior 13 of pole 2. Electrical cable 12 extends about a plurality of rollers 15 rotatably mounted between a pair of support brackets 16 which are mounted on the top of base plate 5. Cable 12 is connected to a source of electrical power at a junction box 17 at the base of pole 2 which is accessible through a hand-hole 18.

Figure 2:
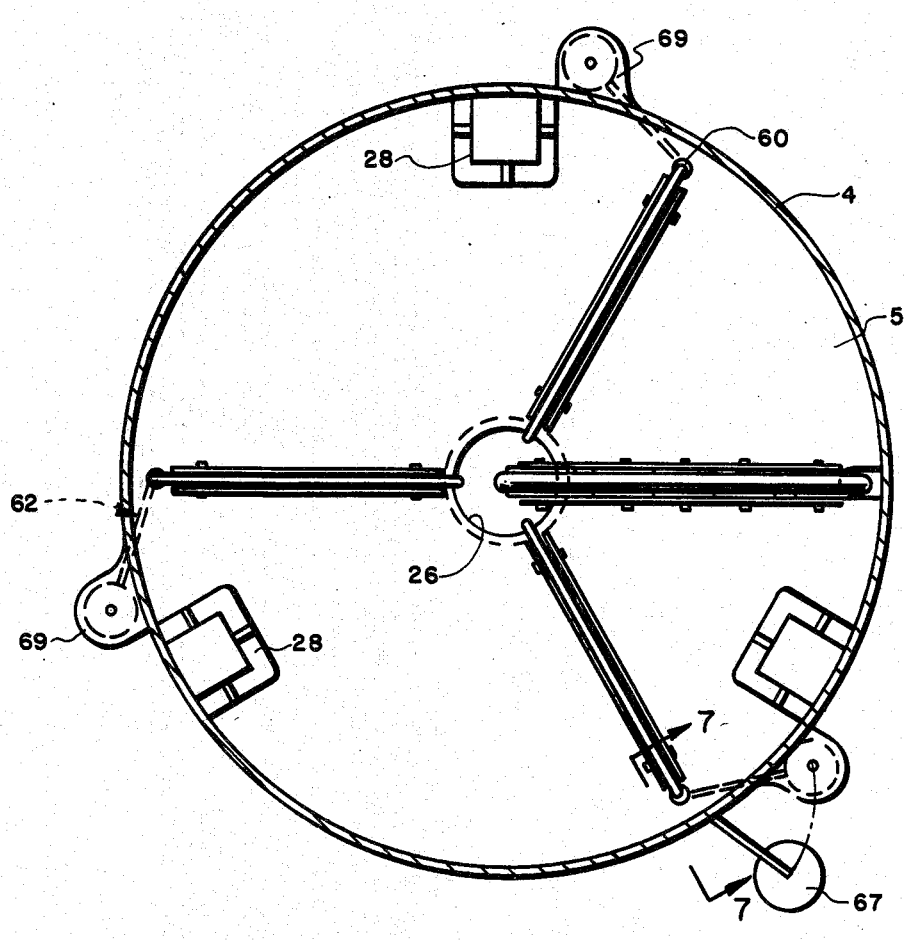
FIG. 2 is a sectional view taken on line 2—2, FIG. 1.

Support ring 7 is moveably mounted on pole 2 by a plurality of cables 20, preferably three as shown in the drawings. Cables 20 extend through pole interior 13 from a common strain plate 21 (FIG. 8) which is connected to a power driven winch 22 by a single cable 23. Each cable 20 extends over a pair of spaced sheaves 24 which are mounted on mast head base 5 by a pair of spaced bracket plates 25. Sheaves 24 are equally spaced about base 5 as shown in FIG. 2 and extend radially outwardly from a central opening 26 of base 5 which aligns with pole interior 13. A plurality of latch mechanisms 28 similar to the latching mechanisms of the type shown in U.S. Pat. No. 4,228,488 are mounted on base plate 5 for engagement with latching rods 29 mounted on and extending upwardly from support ring 7. Cables 20 extend through guide pins 30 which are attached to the bottom surface of plate 5 and project downwardly there- from.

Figure 3:
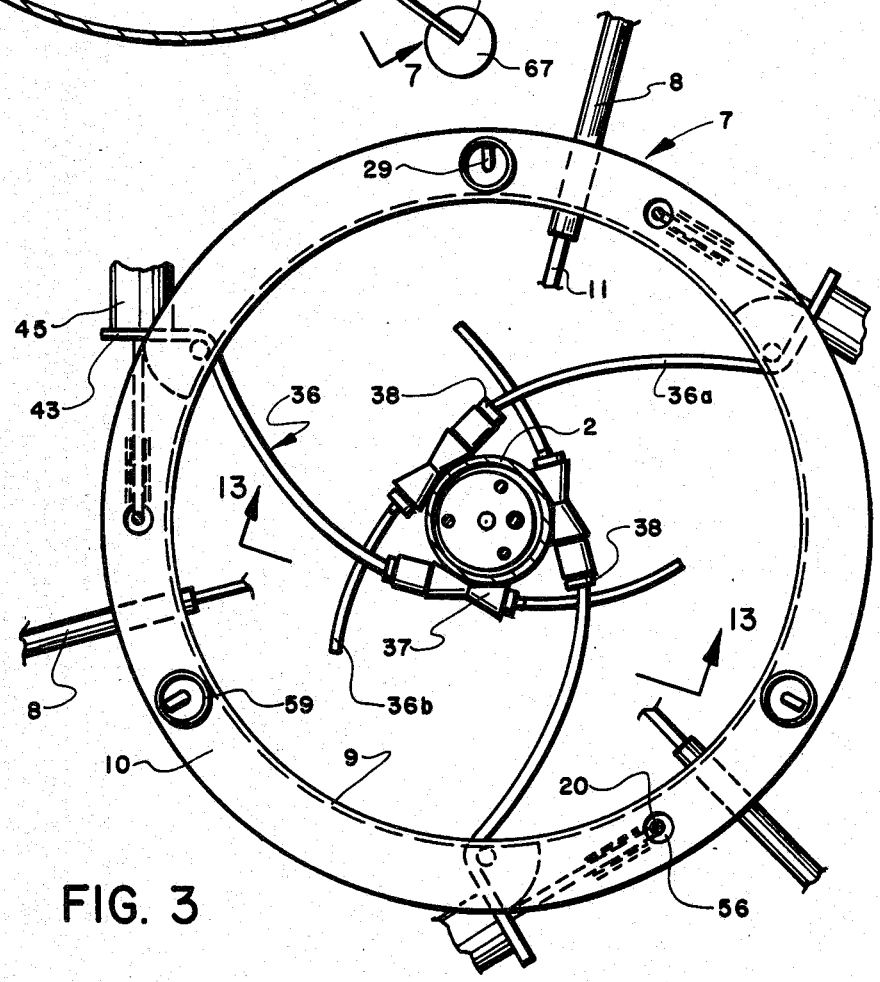
FIG. 3 is a sectional view taken on line 3—3, FIG. 1.
Figure 13:
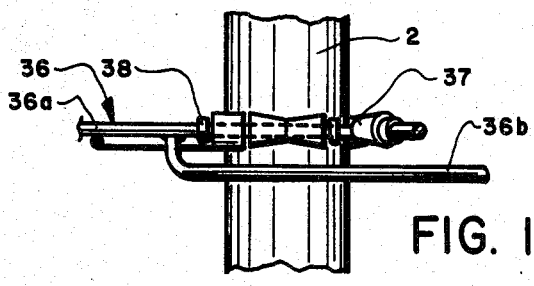
FIG. 13 is a fragmentary sectional view taken on line 13—13, FIG. 3.

In accordance with one of the main features of the invention, a plurality of stabilizing assemblies indicated generally at 35, are mounted on support ring 7 for maintaining a constant stabilizing engagement with pole 2 to maintain support 7 centered thereon as it is moved up and down the pole by cables 20. Preferably three stabilizing assemblies 35 are mounted on support ring 7. Each assembly 35 is similar to each other and therefore only one is described in detail below. Each assembly 35 includes a curved stabilizer arm indicated generally at 36, preferably formed of a two-piece cylindrical steel rod having an inner curved section **36*a* and an outer curved end section 36*b* welded in an offset relationship below section 36*a* as shown in FIG. 13. Sections 36*a* and 36*b* form a continuous arc as shown in FIGS. 3 and 4 and extend generally radially outwardly from ring 7 toward pole 2 (FIGS. 3 and 14). A pair of inwardly tapered rollers 37 are mounted on an outer end of each arm section 36*a* by a pair of spaced locking collars 38 for engagement with the outer surface of pole 2**.

Outer end sections **36*b* of arms 36 extend beyond rollers 37 a predetermined distance so that even should ring 7 move off-center from pole 2 and become disengaged from the rollers, the pole will still be trapped between the outer ends of the three arms and will not become disengaged with any of the arms as can occur in prior centering devices where the stabilizer rollers are mounted on the extreme ends of the arm. The inner ends 40 of arms 36 are bent at an included angle of approximately 120° with respect to the main radially extending curved portion of the arm. Arms 36 are pivotally mounted on cylindrical wall 9 of support ring 7 by being welded to a pivot sleeve 39 (FIGS. 5 and 6) which is rotatably mounted on the extended end of a sleeve 41 which is telescopically mounted on a fixed pin 42. Sleeve 41 is welded to cylindrical wall 9 of support ring 7** and projects downwardly therefrom.

A rectangular spring housing mounting plate 43 is welded on the inner end 40 of each arm 36. A cylindrical spring housing 45 is attached to plate 43 and projects outwardly therefrom and contains a compression coil spring 46. The end of each cable 20 is attached to a strand vice 47 which is moveably mounted in the end of housing 45 and which includes a washer 48 that is engaged with spring 46 to provide a termination for cable 20. Spring 46, although used as the termination for each cable 20, does not provide any of the biasing force on stabilizing assembly 35 and particularly on arm 36 thereof. Springs 46 merely provide some resiliency to the system to assist the engagement of support ring 7 with the latching mechanism mounted on mast head 3 to compensate for any manufacturing tolerances and minor misalignments that may occur between the various components.

Figure 11:
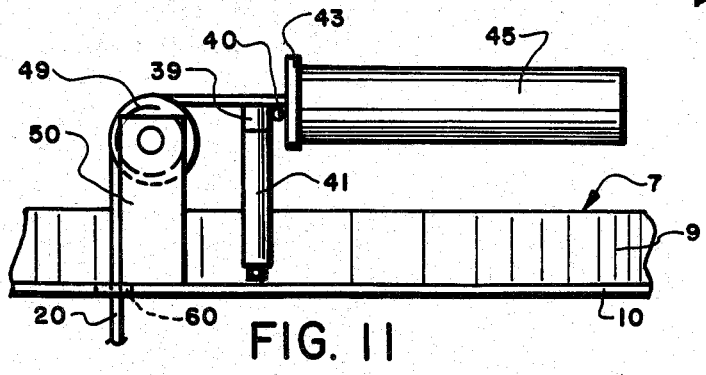
FIG. 11 is an enlarged fragmentary elevational view looking in the direction of arrows 11—11, FIG. 4.

A cable sheave 49 is mounted by a bracket 50 on the bottom surface of annular wall 10 of support ring 7 adjacent to each spring housing 45 and stabilizing arm end 40 (FIGS. 4 and 11). A cable guide indicated generally at 52, is mounted on spring housing mounting plate 43 and projects rearwardly therefrom. Cable guide 52 includes a mounting bracket 53 which is welded to plate 45 and a sheave quadrant 54 (FIGS. 5 and 6) which is mounted on bracket 53 by a bolt 58. Sheave quadrant 54 has an arcuate surface 55 along which cable 20 lies to provide a continuously curved cable engaging surface as arm 36 is rotated about sleeve 41 as the diameter of pole 2 changes during the vertical movement of support ring 7.

Cables 20 after leaving spring housings 45 change direction 90° as they move about cable sheaves 49 from a horizontal position to a vertically upwardly extending position through holes 56 (FIG. 3) formed in annular top wall 10 of support ring 47. Cables 20 extend vertically upwardly from ring 7 and extend through another cable entrance hole 60 (FIGS. 1 and 2) formed in mast head base 5 after which they move into a horizontal direction through plate opening 26 and into pole interior 13. Cables 20 pass through the pole interior and terminate at strain plate 21 by end connections 57 as shown in FIG. 8. Preferably all three cables 20 terminate at strain plate 21 as shown in FIG. 8 after which single main cable 23 extends downwardly toward winch 22. Various other types of connections may be used other than strain plate 21 as shown in FIG. 8 without affecting the concept of the invention. Latching rods 29 preferably are located within cylindrical sleeves 59 as shown in FIG. 1 and 3 for engagement with latching mechanisms 28 mounted on mast head base plate 5.

The operation of the improved stabilizing device is described below with particular reference to FIGS. 1, 3, and 4. Ring 7 is supported entirely by cables 20 which extend over mast plate sheaves 24 and through guide pins 30 with the vertical direction of the cables being changed to a horizontal direction by support ring sheaves 49. Thus, the entire stabilizing and centering force exerted on stabilizing arms 36 is caused entirely by the weight of support ring 7 through the pivotal connection of spring housing mounting plates 43 and attached arms 36 by the exerted force of cable terminals 47 through springs 46.

The cable tension pivots arms 36 toward and into engagement with pole 2 as shown particularly in FIG. 4. Since the weight of the support ring and associated hardware mounted thereon does not change as the cable is raised and lowered along pole 2, the tension in the individual cables 20 will not change, and accordingly the biasing force exerted by arms 36 and associated contact rollers 37 against the outer surface of pole 2 will not change. Therefore, even though the diameter of pole 2 changes considerably throughout the length of a high pole from several feet at the base to several inches at the top, the same stabilizing force will be exerted against the pole regardless of the elevation of the support ring. Such a constant linear stabilizing and support ring centering force is not possible in prior stabilizing and centering devices which use springs for the biasing force since the biasing force of springs is not linear.

In accordance with another feature of the invention, an improved latch signalling device is incorporated with support ring 7. The improved signalling device is indicated generally at 62, and is shown particularly in FIGS. 1, 7, and 10. Device 62 includes a 90° helical shaped wire 63 terminating in integrally formed lower and upper circular ends 64 and 65, respectively. Upper end 65 terminates in a horizontally outwardly extending portion 66 on which a disc-shaped shield 67 is attached. Shield 67 is generally complementary in shape and size to a high visibility disc 68 mounted on the bottom surface of a generally disc-shaped projection 69 extending outwardly from the periphery of mast head base plate 5 at three equally spaced locations as shown in FIG. 2.

Figure 7:
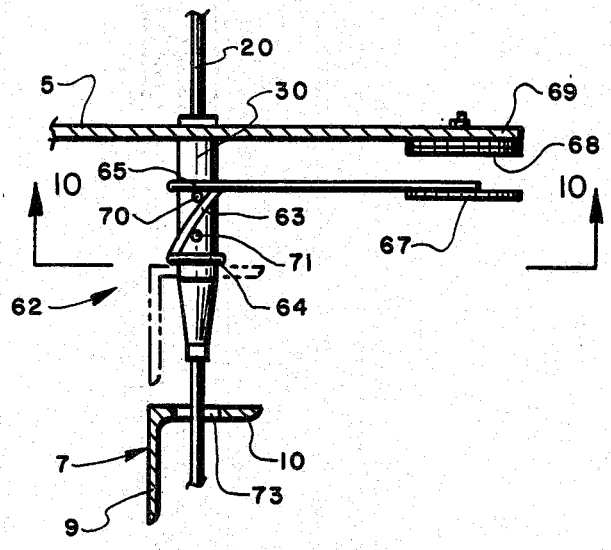
FIG. 7 is an enlarged fragmentary sectional view taken on line 7—7, FIG. 2 showing the improved latch indicating signalling device.
Figure 10:
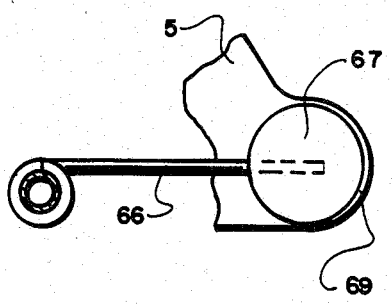
FIG. 10 is a fragmentary sectional view taken on line 10—10, FIG. 7.
Figure 9:
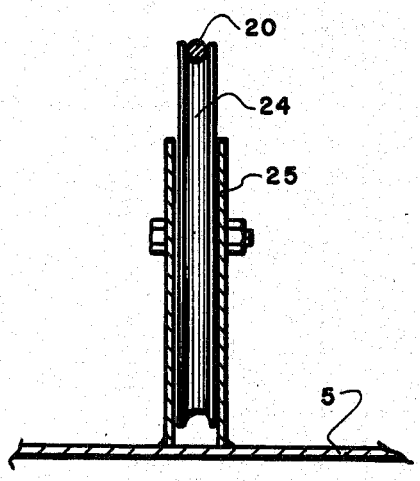
FIG. 9 is an enlarged fragmentary sectional view taken on line 9—9, FIG. 1.

When support ring 7 is in the unlatched position as shown in FIG. 1, shield 67 is in the position as shown in FIGS. 7 and 10 in which it covers high visibility disc 68 blocking it from view by an operator or workman at ground level. When in the unlatched position, upper circular end 65 of signalling device 62 is supported by and rests on a pin 70 extending outwardly from guide pin 30 with helical wire 63 extending angularly between pin 70 and a lower spaced pin 71 (FIG. 7).

Upon vertical upward movement of support ring 7, guide pins 30 will extend through vertically aligned holes 56 formed in annular wall 10 of support ring 7 as shown in FIG. 7. The conical lower shaped end of guide pins 30 enable alignment with holes 56 so that as support ring 7 moves vertically upwardly toward a latched position with mast head 3, latching rods 29 of support ring 7 will be aligned with the associated latching mechanisms 28 on mast head base 5. As support ring 7 reaches the latched position, annular wall 10 will engage the bottom circular wire end 64 as shown in dot-dash lines in FIG. 7 and continued upward movement will force helical wire 63 upwardly about pins 70–71 rotating extension arm 66 and shield 67 90° to the full line position shown in FIG. 2 enabling a workman at ground level to see the exposed high visibility disc 68 indicating that the particular latching mechanism associated with the particular visibility disc is in a latched position.

Figure 12:
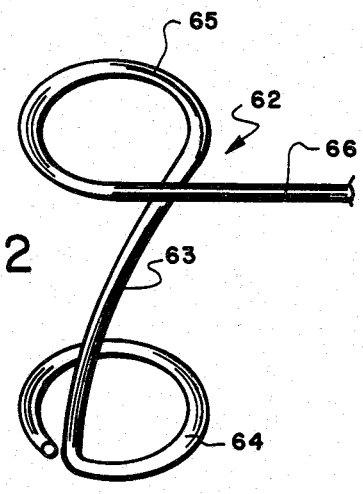
FIG. 12 is an enlarged fragmentary perspective view of the improved signalling device removed from the guide pin.

This signalling arrangement is achieved by a very simple and inexpensive construction consisting only of a metal wire bent into the helical configuration as shown in FIG. 12 and having a metal disc 67 welded on the outer end of extension 66. Device 62 is supported on existing guide pin 30 by a pair of outwardly projecting pins 70 and 71. Thus, in addition to guiding support ring 7 into latching engagement with the head mast latching mechanism, guide pin 30 also functions as the support for signalling device 62.

In accordance with another feature of the invention, the outer ends **36*b* of arms 36 extend a predetermined distance beyond pole engaging rollers 37 as shown particularly in FIGS. 3, 4, and 13. This outward extension of the stabilizing arms prevent the accidental movement of the arms past the pole in the biasing direction should support ring 7 move a considerable distance off-center, as for example upon experiencing an extremely strong wind during movement of the ring along the pole. Even if ring 7 moves off-center and rollers 37 become disengaged from pole 2, arm extensions 36*b* will still entrap the pole between the three arms and prevent one of the arms from moving beyond the pole in the biasing direction. Should this excess movement of the stabilizing arms occur as in prior centering and stabilizing devices, it requires a difficult and costly maintenance operation to realign the arms in their proper position. Even though the pole would move out of contact with the rollers, the arm extensions will trap the pole enabling the rollers to regain contact with the pole upon subsequent vertical movement of the support ring. Preferably arm extensions 36*b* are at least one foot beyond the ends of outermost roller 37**.

In the preferred embodiment the curved portion of each arm 36 has a length of approximately 24 inches with a radius bend of approximately 19½ inches and an arcuate length of approximately 70°.

Accordingly, the improved stabilizing device 1 provides a constant and linear biasing force by a plurality of stabilizing assemblies against the pole as the support ring moves vertically along the pole without any variation caused by the change in the pole diameter. Also improved signalling device 62 provides a relatively inexpensive and uncomplicated device for indicating to a workman located at ground level that support ring 7 is in its latched position at all three latching positions. Also, improved stabilizing device 1 provides a construction which is formed of a relatively few number of parts thereby reducing costs as well as maintenance problems which is extremely critical in high lighting pole installations.

Accordingly, the improved stabilizing device is simplified, provides an effective, safe, inexpensive, and efficient device which achieves all the enumerated objectives, provides for eliminating difficulties encountered with prior devices, and solves problems and obtains new results in the art.

In the foregoing description, certain terms have been used for brevity, clearness and understanding; but no unnecessary limitations are to be implied therefrom beyond the requirements of the prior art, because such terms are used for descriptive purposes and are intended to be broadly construed.

Moreover, the description and illustration of the invention is by way of example, and the scope of the invention is not limited to the exact details shown or described.

Having now defined the features, discoveries and principles of the invention, the manner in which the improved stabilizing device for a luminaire support ring is constructed and used, the characteristics of the construction, and the advantageous, new and useful results obtained; the new and useful structures, devices, elements, arrangements, parts, and combinations, are set forth in the appended claims.

What is claimed is:

1. An improved device for raising and lowering a luminaire support ring on a pole including:

(a) a support ring adapted to be telescopically mounted about the pole for vertical movement along the pole;

(b) cable means for raising and lowering the support ring along the pole;

(c) a plurality of stabilizing arms pivotally mounted on the support ring and operatively connected to the cable means, said arms being biased by the tension in the cable means into engagement with the pole to maintain the support ring centered about the pole as it is raised and lowered along the pole, with the tension exerted by the arms against the pole remaining generally constant throughout the length of the pole uneffected by the changing diameter of the pole, and with said arms extending a predetermined distance beyond the pole to prevent disengagement of the arms from the pole if the support ring is moved off-center from said pole.

2. The device defined in claim 1 in which three stabilizing arms are mounted in an equally spaced relationship on the support ring and extend in a curved direction toward and beyond the pole.

3. The device defined in claim 2 in which roller means is mounted on each of the stabilizing arms for engagement with the pole as the support ring is moved by the cables along the pole.

4. The device defined in claim 3 in which each of the roller means includes a pair of tapered inwardly extending rollers.

5. The device defined in claim 2 in which the cable means includes three cables, each operatively connected to a respective one of the stabilizing arms by a coil compression spring.

6. The device defined in claim 5 in which each of the stabilizer arms is pivotally mounted on the support ring by a cable guide having a curved cable engaging surface.

7. The device defined in claim 6 in which first cable sheaves are mounted on the support ring adjacent the stabilizer arms for changing the direction of the cables 90° from a horizontal arm engaging direction to a vertical upward direction; and in which the cables extend vertically upwardly from the stabilizing ring about second cable sheaves located on a fixed support adjacent the top of the pole and then downwardly through the interior of the pole.

8. The device defined in claim 5 in which each of the compression coil springs is located within a housing mounted on the cable guide.

9. The device defined in claim 7 in which the support ring includes an annular-shaped horizontal plate; and in which the first cable sheaves and cable guides are mounted on an under side surface of said horizontal plate.

10. The device defined in claim 7 in which signal means is mounted on the fixed support adjacent the top of the pole for providing a visual indication to an operator at ground level that the support ring is in a latched position with respect to the fixed support.

11. The device defined in claim 10 in which the signal means includes a 90° helical-shaped wire movably mounted on a guide pin mounted on the fixed pole top support and projecting downwardly therefrom; in which a cover plate projects outwardly from one end of the wire and is rotated 90° to provide the visual indication upon the wire being contacted by the support ring as it moves upwardly into latching engagement with the fixed plate.

12. The device defined in claim 11 in which the guide pin is hollow; and in which one of the cables extends through the guide pin downwardly into engagement with one of the stabilizing arms.

13. The device defined in claim 11 in which the signal means helical-shaped wire is supported on the guide pin by a pair of spaced outwardly projecting pins.

14. The device defined in claim 11 in which a high visability member is mounted on a bottom surface of the fixed support; and in which the signal means cover plate uncovers the high visibility member when rotated by the helical-shaped wire upon the support ring achieving a latched position.

15. The device defined in claim 14 in which three guide pins are mounted on the fixed support, each of which is hollow with a respective cable extending through each of said guide pins; and in which the fixed support is a generally disc-shaped plate with three high visability members projecting outwardly at three spaced locations on its periphery.

16. An improved device for maintaining and stabilizing a support ring in a predetermined position encircled about a pole, said ring being of the type which is raised and lowered along the pole by a plurality of cables which extend upwardly through the pole interior and over cable sheaves mounted on a fixed platform on top of the pole and then downwardly to the support ring; said device including a plurality of stabilizing arms movably mounted on the support ring and operatively connected to the cables whereby the tension in the cables bias the arms horizontally inwardly into engagement with the pole, said arms having a length greater than the radius of the support ring so as to extend beyond the pole to prevent disengagement of the arms from said pole; and cable sheave means mounted on the support ring adjacent the stabilizing arms for changing the direction of the connected cables 90° from vertical to horizontal for connection to the stabilizing arms.

17. An improved device for maintaining a luminare support ring centered about a pole as the support ring is being moved vertically along the pole by a plurality of cables, said device including:

(a) a plurality of spaced arms pivotally mounted on the support ring and extending in an arcuate radially inwardly extending direction toward the center of the ring, said arms each having a pole engaging roller mounted thereon;

(b) pivot means for pivotally mounting the arms on the support ring; said pivot means including a cable guide having a curved cable engaging surface and a cable termination plate;

(c) a spring housing attached to the cable termination plate; and (d) a compression coil spring located within the spring housing, and a cable terminal mounted on the cable and tensioned by the cable into compression engagement with the coil spring for applying the tension in the cable to the pivot means to pivot the arms toward and against the pole for applying a constant force against the pole in direct relationship to the tension in the cables uneffected by changes in the diameter of the pole.

18. The improved device defined in claim 17 in which the arms are each formed of a metal rod; and in which an end portion of said rod extends at least twelve inches beyond the pole engaging rollers.

19. The improved device defined in claim 18 in which the arms have an arcuate portion with a length of approximately 70°.

20. The improved device defined in claim 19 in wich the pivot means includes a sleeve attached to the metal rod at the junction of the arcuate portion of the rod and an end terminal portion of the rod which forms an include angle of approximately 120° with the arcuate portion; and in which the terminal end portion is attached to the cable termination plate.

21. The improved device defined in claim 18 in which the metal rod of each of the arms is formed of first and second arcuate sections; in which the rollers are mounted on an outer end of the first section; and in which the second section is connected to the first section in an offset relationship and extends outwardly therefrom in the same arcuate path as said first section.

* * * * *